US006814652B2

(12) United States Patent
Loth

(10) Patent No.: US 6,814,652 B2
(45) Date of Patent: Nov. 9, 2004

(54) METHOD TO SHARPEN THE CUTTING KNIFE OF A KNIFE RING CHIPPER

(75) Inventor: Robert Loth, Lage-Mussen (DE)

(73) Assignee: B. Maier Zerkleinerungstechnik GmbH, Bielefeld (DE)

( * ) Notice: Subject to any disclaimer, the term of this patent is extended or adjusted under 35 U.S.C. 154(b) by 0 days.

(21) Appl. No.: 10/117,407

(22) Filed: Apr. 5, 2002

(65) Prior Publication Data

US 2002/0173246 A1 Nov. 21, 2002

(30) Foreign Application Priority Data

Apr. 7, 2001 (DE) ..... 101 17 480

(51) Int. Cl.[7] ..... B24B 1/00

(52) U.S. Cl. ..... 451/45; 451/193; 451/321; 451/419; 451/421

(58) Field of Search ..... 451/45, 54, 66, 451/67, 73, 192, 193, 229, 234, 374, 321, 419, 420, 421, 196, 203; 76/82, 85; 144/176, 218, 241

(56) References Cited

U.S. PATENT DOCUMENTS

| | | | | |
|---|---|---|---|---|
| 3,559,705 A | * | 2/1971 | Salzmann, Jr. | 144/162.1 |
| 3,941,319 A | | 3/1976 | Pallmann | |
| 4,218,024 A | | 8/1980 | Pallmann | |
| 4,545,413 A | * | 10/1985 | Sundberg et al. | 144/176 |
| 4,784,337 A | * | 11/1988 | Nettles et al. | 241/92 |
| 5,209,025 A | * | 5/1993 | Martin et al. | 451/421 |
| 5,217,424 A | | 6/1993 | Pallmann | |
| 5,525,094 A | | 6/1996 | Pallmann | |
| 5,564,967 A | * | 10/1996 | Jorgensen | 451/45 |
| 5,688,161 A | * | 11/1997 | Gregory et al. | 451/45 |

FOREIGN PATENT DOCUMENTS

| | | |
|---|---|---|
| DE | 41 14 840 | 11/1992 |
| DE | 43 16 514 | 11/1994 |

* cited by examiner

*Primary Examiner*—Hadi Shakeri
(74) *Attorney, Agent, or Firm*—Baker & Daniels

(57) ABSTRACT

A method for sharpening the cutting knives of a knife ring chipper, which includes a knife ring and a number of knife units, the units in turn containing knives and holding plates. The knife ring is removed from the knife ring chipper, the knife units of the knife ring chipper are removed from the knife ring and the knife units are disassembled. The dull knives are moved to a first buffer station and are stored and then moved to a grinder and sharpened. The sharpened knives are moved to a second buffer station and are stored, and the sharpened knives are then mounted onto holding plates in knife units. The knife units are incorporated into a knife ring and the knife ring is incorporated into a knife ring chipper.

4 Claims, 3 Drawing Sheets

METHOD TO SHARPEN THE CUTTING KNIFE OF A KNIFE RING CHIPPER

BACKGROUND OF THE INVENTION

The invention concerns a method to sharpen the cutting knife of a knife ring chipper. This includes specifically knife ring chippers to process wood into wood chips for further industrial processing, such as raw material for chipboards.

Such chippers have a knife ring, which supports a number of knife units. The knife units are arranged such that the cutting edges of the knives run parallel to the axis of the knife ring. Each unit contains a cutting knife, which extends with its cutting edge to the inside, and a holder plate, to which the knife is attached by a screw.

A rotor rotates in the interior space between the knives. A supply of wood particles is introduced into the interior space, to be thrown against the cutting edges of the knives by the rotor.

The desired chip size is determined by the distance of the knife from the so-called wearing plates, which are, in turn, also a component of the knife ring.

The relatively short useful life of the cutting knives is a major problem. They may be worn out within a few hours and can no longer supply chips of the required quality. The exchange of knives requires a particularly high labor input.

Consequently, efforts have been expended for a long time to improve the exchange of the knives. Thus, one method is known, which includes the following processing steps:

First, the knife basket is removed from the chipper and placed in a sharpening apparatus. The knife basket can be rotated around its own axis in this sharpening apparatus. The dull knives are removed from their holders and are placed n the holder for sharpening the knives at the proper working depth. The knives are then sharpened and are subsequently reinserted in the knife basket. The sharpening process uses grinding tool that includes one or several grinding disks. The grinding tool moves parallel t the axis of the knife bodies. If the tool uses several grinding disks, they are arranged side-by-side and are all used simultaneously. The knife ring is turned after each grinding operation , until all knives have been sharpened.

Admittedly, machines of this type have shown their value. However, the construction cost is high, and this inflates the production cost of chip material. In addition, the machine can be operated efficiently only if there is no breakdown and with only a limited number of knife types.

SUMMARY OF THE INVENTION

The invention is focused on the objective of developing a method that allows for flawless, fast and efficient sharpening of the dulled knives and which also fulfills the technological requirements for the quality of chipping, even if operation does not run flawlessly. In addition, it should also allow for efficient sharpening of knives of several different knife ring types. Finally, the production costs of the final hipped material should be as low as possible.

The essential steps of the method according to the invention are the following:

First remove the knife ring from the knife ring chipper. Then disassemble the knife units, which means that the individual knife is removed from its holder plate and sharpened.

The intermediate storage of the dull and sharpened knives in separate buffer stations is an important step in this method. This has the advantage that the sharpening process can be decoupled from the assembly process, which decreases the cycle time. Cycle time is defined as the time from input of the dull knife unit until ejection of the sharpened knife unit from the system. This method of disassembly and assembly of the knife unit has the additional advantage that the resin deposits between knife and holding plate can be removed by cleaning after disassembly and that the cutting knives may be selected out and replaced, depending on their degree of wear.

The dull knives are inserted in a grinding unit, which grinds off a pre-specified amount or which can determine the amount of grinding independently based upon a measurement of wear. However, the grinding process may also be realized by other chip-removal, thermal or physical-chemical methods. While the grinding of each individual knife requires extra time, it provides for the possibility of individual grinding specifications. This has the advantage that the knives are used for longer periods in production, before they are rejected for insufficient knife width. Thus, the operating hours per knife are increased significantly. Given approximately 60 cutting knives in each knife ring, this generates a reduction of the costs for each knife ring. The holding plate is not replaced during the entire process and is moved online through the processing line. Exceptions relate to very significantly worn holding plates, which are replaced by the user manually.

This method allows the user to specify and set the knife cutting depth individually for each knife ring. Also, the holding plate from each knife ring is re-used in that same ring. This is important for the function of the knife ring.

The knives are held in a certain angle in the buffer station in order to avoid potential contact among the knives. The angle modifies the center of gravity of the knives such that safe stacking of knives with varying width is possible.

An adjustment unit receives the knife units via preselected input points, which vary according to knife type and which may be adapted to the knife unit. This has the advantage that any type of knife unit may be processed in the system with minimal change-over, which provides maximum flexibility for the user. It is also possible to work on units consisting of several components.

The holding plate is firmly held on a mounting base throughout the assembly process. The very precise movement of the mounting base allows for high adjustment precision of the knife depth.

It is most advantageous to use chain holders, which have a high volume with low space requirements, for storage of the incoming or ejected knife units.

BRIEF DESCRIPTION OF THE DRAWINGS

The invention is explained in more detail in the drawings. They show the following.

DETAILED DESCRIPTION

Figure 1A:
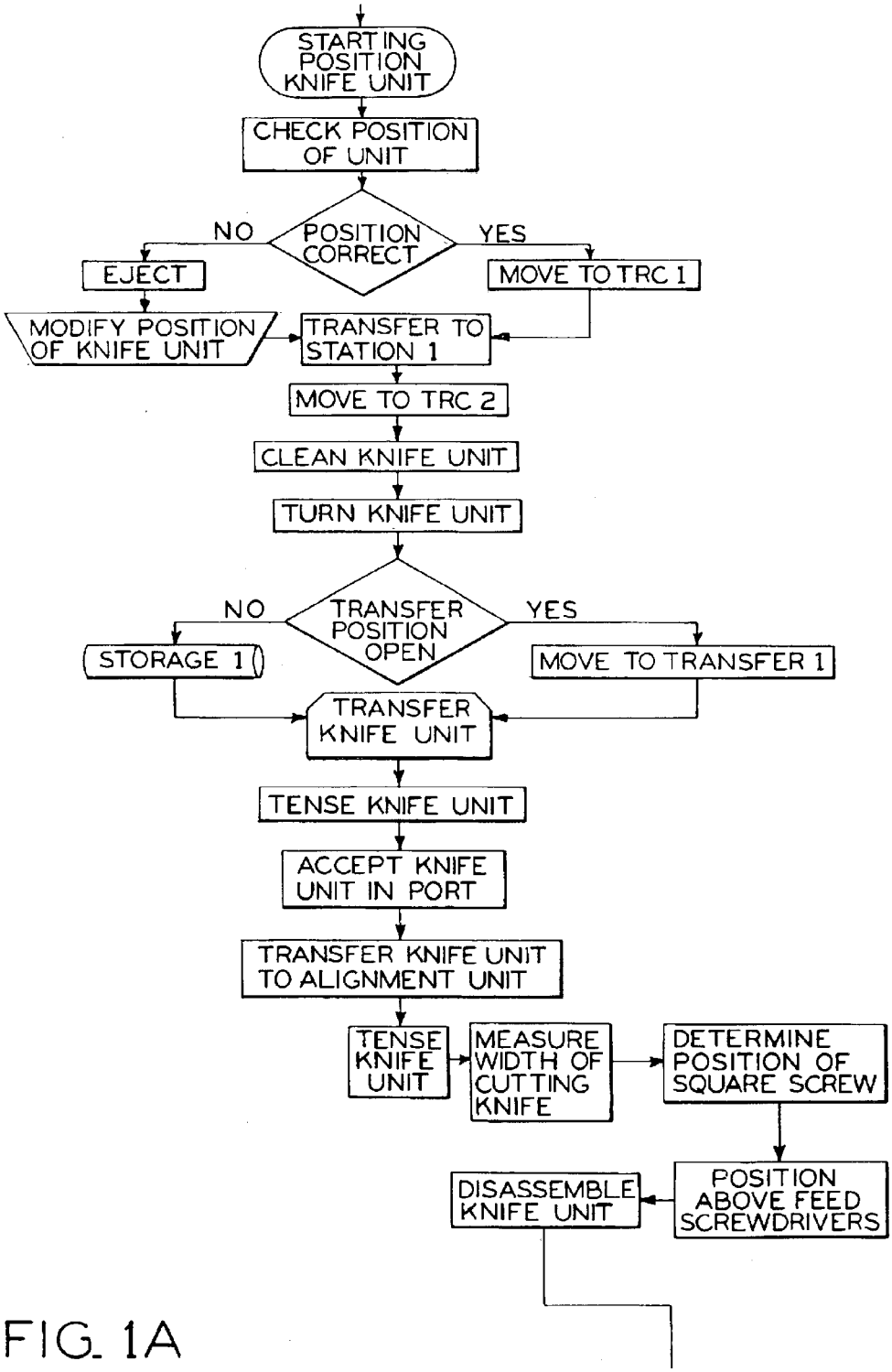
FIGS. 1A, 1B and 1C show a flow diagram to identify processing steps of the method according to the invention.
Figure 1B:
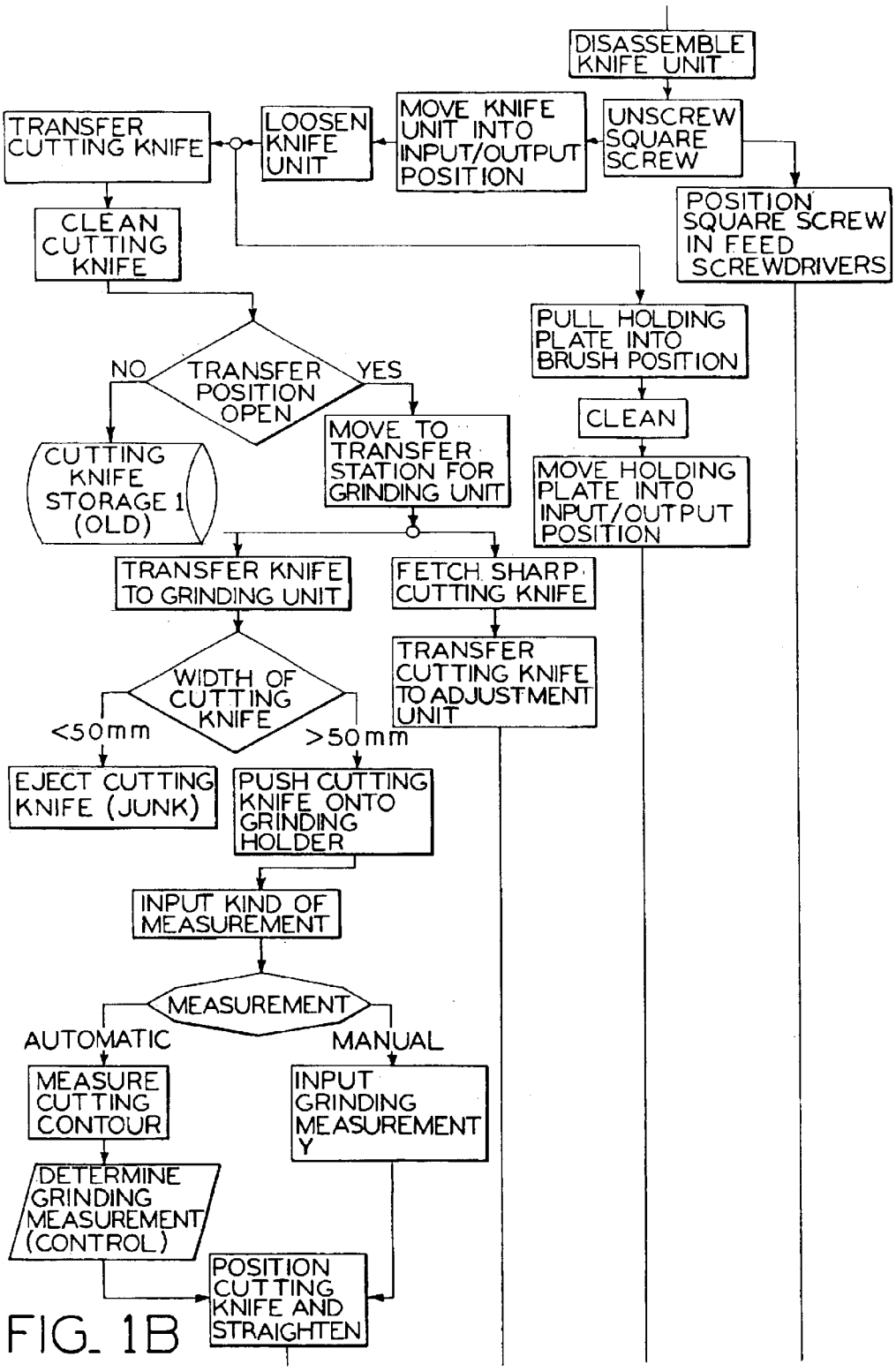
Figure 1C:
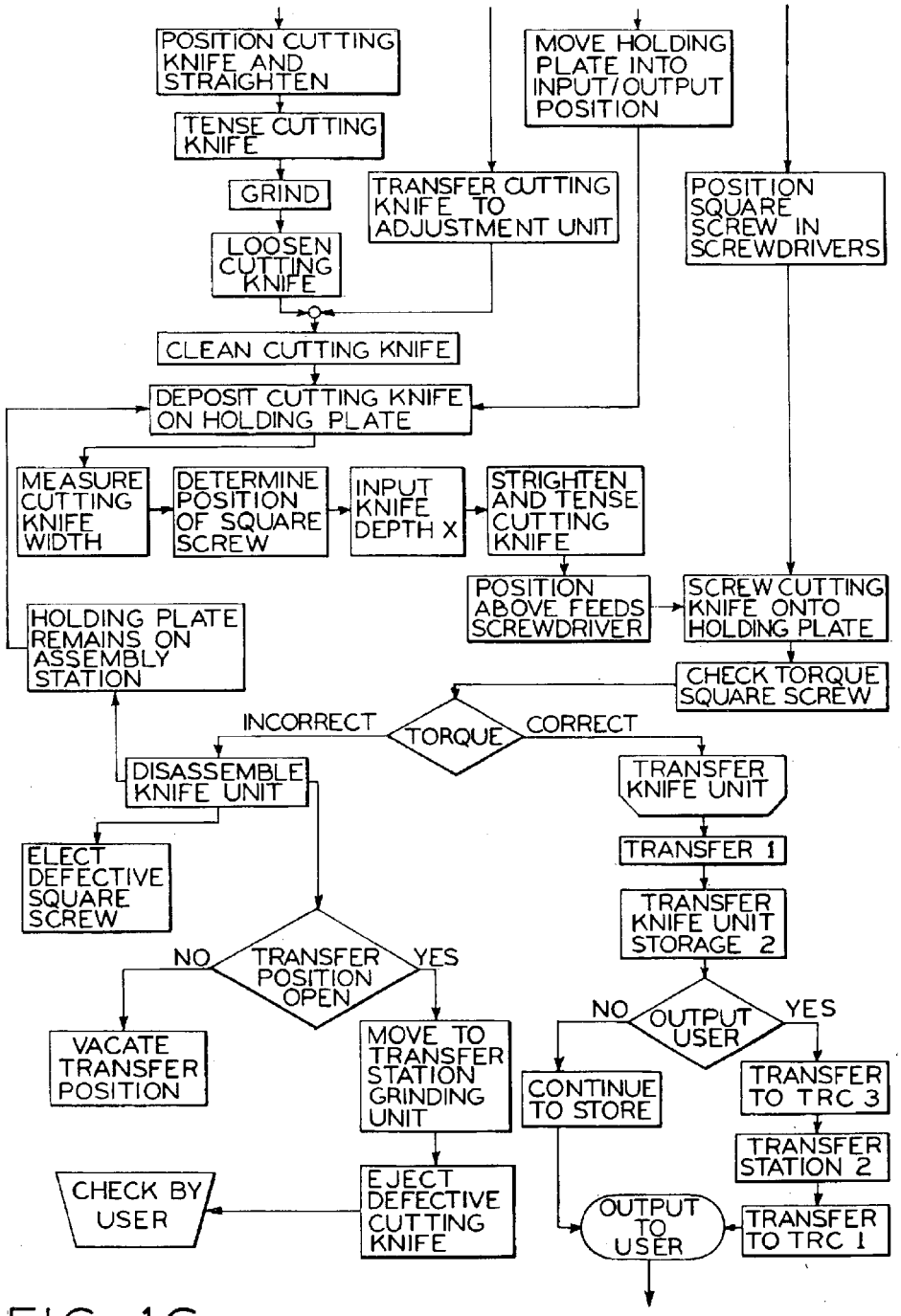

The automated processing method is as follows: As soon as the knives of a knife ring chipper are no longer sufficiently sharp, the knife ring is removed from the knife ring chipper and is inserted into a receiving unit and is held in place.

The user determines the required preliminary settings (knife depth, cycle frequency, grinding depth), removes the knife units and places them on a moving belt, which moves them to the processing unit.

The knife units are cleaned in a cleaning unit and are repositioned into the processing position in a turning unit. After repositioning, the cutting knives point upwards. The incoming knife unit is then either placed in a knife unit holder or it is moved to a conveyor by a transfer. The conveyor accepts the individual knife unit and deposits it on a mounting base which is movable within an adjustment unit and possesses all functions to accept and hold the knife unit and the holding plate. The knife unit is then held and tensed by means of receivers. The positions of square head bolts are then determined and the mounting base is repositioned to the position of the feed screwdrivers.

Once the screws are loosened by the feed screwdrivers the conveyor accepts the dull cutting knife and places it in a buffer station or inserts it into the grinder. Conveyor also feeds into the grinder and the associated buffer station during subsequent operation. After the dull knife is cleaned and deposited the conveyor removes a sharpened knife from another buffer station for sharpened cutting knives and deposits it on the cleaned holding plate, which has meanwhile been moved through a brush unit for cleaning. The deposited knife is pushed against a solid stop plate to determine the knife depth. The positions of the square head bolts are then determined again, the mounting base is moved into position, and the knife is screwed onto the holding plate. Once this process is completed, the sharpened knife unit is removed from the mounting base and is removed by the conveyor. It is then placed in a transfer and is inserted into an additional knife unit holder. It is stored there and it is turned into the working position (cutting knife down). Upon request of the user, the sharpened knife unit is then removed from knife unit holder and is transferred into the operating position ready for use by means of a transport belt.

What is claimed is:

1. A method to sharpen the dull knives of a knife ring chipper, which contains a knife ring and a number of knife units, which in turn contain dull knives and holding plates, comprising the following process steps:

removing the knife ring from the knife ring chipper;

removing the knife units from the knife ring;

disassembling the knife units;

then moving the dull knives to a first buffer station and storing the knives there;

moving the dull knives to a grinder and sharpening the knives there;

moving the sharpened knives to a second buffer station and storm the knives there;

mounting the sharpened knives onto holding plates to form knife units;

then incorporating the knife units into a knife ring; and then incorporating the knife ring into a knife ring chipper.

2. The method according to claim 1, wherein the dull knives and the holding plates are cleaned after disassembly.

3. The method according to claim 2, wherein a knife depth of the sharpened knives is adjusted during the assembly of the knife units.

4. The method according to claim 1, wherein a knife depth of the sharpened knives is adjusted during assembly of the knife units.

* * * * *

UNITED STATES PATENT AND TRADEMARK OFFICE

CERTIFICATE OF CORRECTION

PATENT NO. : 6,814,652 B2
DATED : November 9, 2004
INVENTOR(S) : Robert Loth

It is certified that error appears in the above-identified patent and that said Letters Patent is hereby corrected as shown below:

Column 4,
Line 17, delete “storm” and insert therefor -- storing --.

Signed and Sealed this

Fifteenth Day of March, 2005

JON W. DUDAS
*Director of the United States Patent and Trademark Office*